United States Patent [19]

O'Neill

[11] 4,228,627

[45] Oct. 21, 1980

[54] REINFORCED FOUNDATION STRUCTURE

[76] Inventor: Joseph C. O'Neill, 3101 E. Steger Rd., Chicago Heights, Ill. 60411

[21] Appl. No.: 30,343

[22] Filed: Apr. 16, 1979

[51] Int. Cl.[2] ..... E02D 27/42; E04B 1/41

[52] U.S. Cl. ..... 52/295; 52/40; 52/169.13; 52/296

[58] Field of Search ..... 52/295, 40, 296, 169.13, 52/170, 127

[56] References Cited

U.S. PATENT DOCUMENTS

| | | | |
|---|---|---|---|
| 1,189,459 | 7/1916 | Lunden | 52/295 X |
| 1,378,351 | 5/1921 | Hoyle | 52/295 |
| 2,625,815 | 1/1953 | Black | 52/295 X |
| 3,838,547 | 10/1974 | Meisberger | 52/296 |
| 3,942,296 | 3/1976 | Meyer | 52/296 |
| 4,114,344 | 9/1978 | Heasman | 52/726 |

*Primary Examiner*—Alfred C. Perham

*Attorney, Agent, or Firm*—James T. FitzGibbon

[57] ABSTRACT

A foundation structure for supporting a high rising light pole in which a plurality of vertically extending reinforcing rod assemblies are arranged in a circle with the tops bolted to a base plate on the bottom of the pole and extending downwardly into a vertical earth bore of relatively small diameter, each rod assembly comprising a bottom section of conventional carbon steel which is connected by a threaded coupling to a top section of high tensile strength heat treated steel, the assembly being set in the bore hole which is then filled with concrete.

6 Claims, 4 Drawing Figures

REINFORCED FOUNDATION STRUCTURE

BACKGROUND OF THE INVENTION

The present invention relates generally to reinforced structures, and more particularly, to improved reinforced concrete foundation structures used in the erection of electric power, transmission towers, light poles, and other structures wherein a load is intended to be supported at great height above the ground.

At present, it is the practice to mount light poles, highline towers, and the like, on foundations which comprise generally cylindrical reinforced concrete structures extending well below the ground, a distance which is selected in relation to the height of the supported structure which, in many cases, aggregates 40, 60, or 80 feet by way of example. The tower or pole is supported on a flat plate or ring, having a plurality of fastener receiving openings therein. The pole extends upwardly from this ring which is formed integrally with, or attached by welding to a part of the above ground structure. When the pole or tower element is disposed over the foundation member, pieces of threaded rod which are embedded in the foundation member extend upwardly through the openings in the ring. These are indexed with the holes and the structure is mounted by attaching nuts to the ends of the threaded rods and tightening them in position. This holds the tower, pole or other structure down onto the foundation member. The foundation member consists of a caselike, or cylinderlike, concrete structure wherein the reinforcing rods or bars extend substantially the entire length or depth thereof. Because the poles, towers, or the like, are subjected to considerable stress, it has been a requirement that the threaded rod, which acts both as a mounting means for the pole and as a reinforcing bar for the concrete, be made from a heat treated, high tensile strength steel material. This is because it is desired that the supported structure not fail at the connection as might be the case if a soft, relatively low grade steel were used. In the past, before standards were adopted which call for the use of high quality heat treated, high tensile strength rod material, there were occassional failures in use which resulted from breaking of the rod at the fasteners. This failure was usually due to work hardening of material as the threads were cut or rolled on the rod, or to the fact that the threaded rod, as manufactured, had faults or impurities therein, or for other reasons. Consequently, high strength heat treated materialwas specified to minimize the risk of breakage at the point wherein the maximum stress was concentrated, namely, at the top of the foundation, where the pole, or tower structure was mounted to the foundation. In current practice, as a result of adopting standards referred to above, it has been customary to use high tensile strength heat treated reinforcing rods running the entire length of the casing or column, in this case, such depth reaching as much as 80 feet. Since such material is highly expensive, the requirement for the use of high quality material has greatly increased the cost of this type foundation structure and a need has arisen for the design of a foundation structure of this type which will meet the strength requirements and which can be built at a substantially smaller cost.

It is a general object, therefore, of the present invention to provide an improved foundation structure of the type which is particularly adapted for supporting electrical transmission towers, light poles and similar structures which rise to a substantial height above the foundation and exert considerable tensile and shear stress at the base where they are joined to the foundation structure.

It is a more specific object of the invention to provide an improved method of constructing a foundation structure of the type which is employed for supporting relatively high electric line poles, power transmission towers, or similar structures, where the foundation structure may be constructed on the site and where it may be capable of exerting the high tensile and shear strength necessary to maintain the pole or tower structure in its upright position under adverse conditions.

A still more specific object of the invention is to provide an earth pile anchorage structure which will serve as a reinforced load bearing column wherein a composite reinforcing bar is combined with concrete, which reinforcing bar is formed by connecting an upper rod section of heat treated material to a lower rod section of good grade reinforcing steel bar stock by means of a specially designed coupler unit.

Another object of the invention is to provide a concrete column for supporting a pole, or similar structure, which is reinforced with one or more composite reinforcing rods comprised of a high tensile strength steel section, an ordinary steel reinforcing rod section, and a connector which serves to couple the steel sections together, which is easily assembled and which includes an inspection opening to insure that assembly is completed, with the composite rod structure or structures being adapted to be held in place by fixtures in the opening of a vertical bore of suitable size into which concrete may be poured to create a structure which is capable of supporting the pole and withstanding shearing and bending forces to which the upper portion may be subjected, and the tensile forces which will be distributed throughout the height of the column.

Still antoher object of the invention is to provide a reinforced concrete column arrangement for supporting a tower or pole structure which has the strength required by current specifications for such structures and which can be fabricated at lower cost than currently available column arrangements.

A further object is to provide a composite reinforcing member for a reinforced foundation structure which consists of a length of lower grade steel material having a threaded end portion, a length of higher grade material which is preferably threaded throughout and a coupler having an inspection opening insuring that both members are fully inserted therein, with a plurality of the reinforcing members being arranged as reinforcing bars extending longitudinally of the foundation structure.

To this end the invention comprises a method of forming a reinforced structure which is adapted to be employed as a foundation column for a high rising tower or polelike structure wherein one or more reinforcing rod assemblies are set in concrete, which rod assemblies comprise a lower rod section of conventional bar stock reinforcing material which is of substantial length relative to the column height joined by a coupling member to an upper rod section of substantially lesser length than the lower rod section and of a high strength material capable of withstanding relatively high shearing and bending forces.

The foregoing and other objects and advantages of the invention will be best understood when reference is made to the accompanying description of the preferred form of the invention which is set forth herein, by way of example, and shown in the drawings wherein like reference numerals indicate corresponding parts throughout.

DESCRIPTION OF THE PREFERRED EMBODIMENTS OF THE INVENTION

Figure 1:
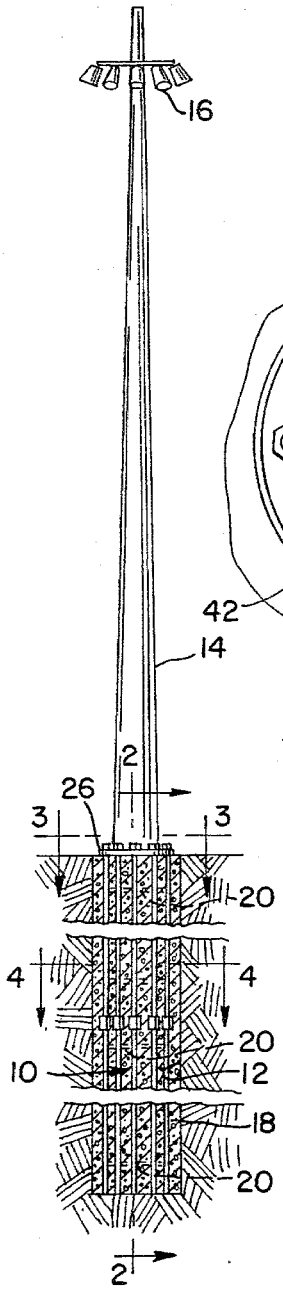
FIG. 1 is an elevational view, with portions broken away, showing a foundation structure embodying the principal features of the invention, the structure being shown in position in a vertical earth bore and supporting a high rising pole member.

Referring first to FIG. 1 of the drawings, there is illustrated a foundation structure 10 which incorporates the principal features of the invention. As shown, the structure 10 has been constructed in a vertical earth bore 12 so as to support a high rising electric light pole 14 of the type which is, for example, employed in supporting, at a high elevation, a cluster of light emitting assemblies 16 for illuminating a vehicle parking area, sports arena, stadium, or the like.

Figure 3:
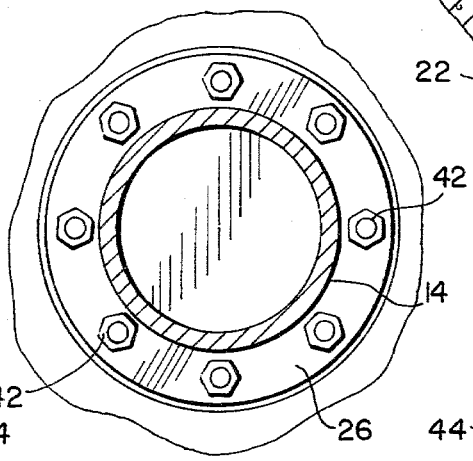
FIG. 3 is a cross sectional view, taken on the line 3—3 of FIG. 1, to an enlarged scale.
Figure 4:
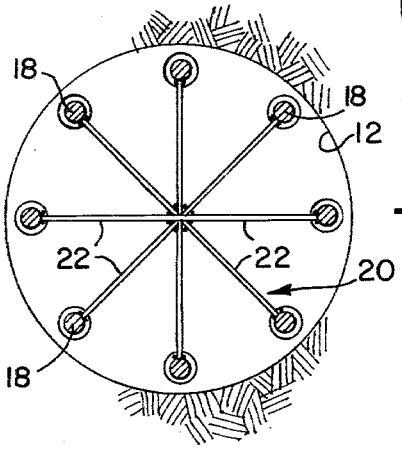
FIG. 4 is a cross sectional view, taken on the line 4—4 of FIG. 1, to an enlarged scale.

In the form shown, the earth bore 12 is excavated in any convenient manner, preferably with the help of conventional mechanical equipment which is available for such purpose. A plurality of specially designed reinforcing rod assemblies 18 are positioned in the bore in properly spaced relation. Any conventional means 20 may be employed, such as, an assembly of wire sections or steel rods 22 extending in radial relation from an axial center and each secured to an assembly 18 so as to hold the assemblies 18 in circumferentially spaced relation corresponding to the disposition of the spaced holes 24 in a base plate 26 (FIG. 3) which is welded or otherwise secured, in the form of a flange, at the bottom end, or base, of the pole 14.

Figure 2:
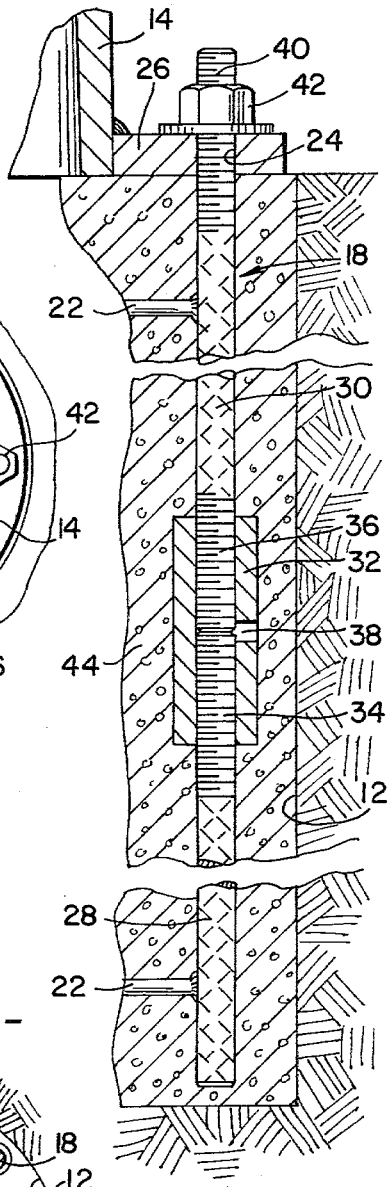
FIG. 2 is a cross sectional view taken on the line 2—2 of FIG. 1, to greatly enlarged scale, and with portions broken away.

The reinforcing rod assemblies 18 are of special construction. As shown best in FIG. 2, each of the assemblies 18 comprises a lowermost or bottom section 28 and an uppermost or top section 30, the two sections being joined by a coupling element 32 in axial alignment. The bottom section 28 may be conventional carbon steel reinforcing rod stock of suitable size since it serves primarily as a reinforcing bar for the lower portion of the foundation member. The uppermost end of the section 28 is threaded at 34 for insertion in the threaded bore of a tubular steel coupling element 32 which serves to rigidly connect the two rod sections 28 and 30 in axial alignment. The uppermost rod section 30, which is subjected to the greatest stress when the pole 14 is buffeted by high winds or exposed to similar forces, comprises a high tensile strength heat treated steel reinforcing rod material having the capability of absorbing the stress, which may be of a high order when the pole 14 is subjected to the forces generated by high winds or other adverse conditions. The rod section 30 has the one end threaded at 36 so that it may be inserted in tight engagement in the uppermost end of the threaded coupling member or sleeve nut 32. The coupling member 32 is provided with a radial aperture or peep hole 38 which enables the operator to see that the ends of the rod sections 34 and 36 are properly inserted and in abutting relation in the coupling member. The rod section 30 is threaded at its upper end at 40 for receiving a washer and nut 42 when it is received in the apertures 24 in the plate member 26 so as to firmly secure the pole 14 on the foundation structure. Alternatively, the rod section 30 may be threaded thorughout its length. The length of the rod section 30 may, of course, be substantially less than the corresponding dimension of the rod section 28 thereby effecting substantial economy through the use of substantially less costly rod material for the longer rod section 28. With the rod assemblies 10 properly positioned in the bore 12, the latter may be filled with the required amount of concrete mixture 44 and allowed to harden. A template (not shown) or other means may be employed to insure that the upper ends of the rod assemblies are held in the proper position to be received in the holes 24 in the base plate 26 on the bottom end of the pole 14 while the concrete hardens.

I claim:

1. A reinforced foundation structure in the form of a concrete column adapted as a support for a relatively high standing light pole or the like, said foundation structure comprising one or more reinforcing rod assemblies embedded in concrete which forms the main body of the columnar structure, said rod assembly comprising a lowermost section of steel reinforcing rod material and constituting a substantial portion of the length of the rod assembly and an uppermost section of a rod material which has a tensile strength and resistance to shear stress substantially greater than the material of the lowermost rod section, said rod sections being joined by a coupling member which connects the rod sections in axial alignment.

2. A reinforced foundation structure as set forth in claim 1 wherein said uppermost rod material is heat treated, high tensile carbon steeel.

3. A reinforced foundation structure as set forth in claim 1 wherein said uppermost rod section is a high tensile strength steel member having a length that is substantially less than the length of the lowermost rod section.

4. A reinforced foundation structure as set forth in claim 3 wherein said rod coupling member comprises a threaded steel sleeve nut.

5. A reinforced foundation structure as set forth in claim 4 wherein said rod coupling member has a radial aperture intermediate its ends which enables the position of the ends of the rod members to be observed.

6. A reinforced foundation structure as set forth in claim 1 wherein said uppermost rod section comprises a length of heat treated high tensile carbon steel of substantially lesser length than said lowermost rod section and said coupling member comprises a sleeve nut rigidly connecting said rod sections and having a radial aperture adjacent the middle of the length of the nut enabling the user to observe the position of the ends of the rod sections which are in threaded engagement therein.

* * * * *

UNITED STATES PATENT AND TRADEMARK OFFICE

CERTIFICATE OF CORRECTION

PATENT NO. : 4,228,627

DATED : October 21, 1980

INVENTOR(S) : Joseph C. O'Neill

It is certified that error appears in the above—identified patent and that said Letters Patent is hereby corrected as shown below:

Column 2, line 10, "may" , second occurrence, should be -- must--.

Column 4, line 43, in claim 2, "steeel" should be -- steel --.

Signed and Sealed this

Third Day of February 1981

[SEAL]

*Attest:*

RENE D. TEGTMEYER

*Attesting Officer*

*Acting Commissioner of Patents and Trademarks*